US008672817B2

(12) United States Patent
Bowser et al.

(10) Patent No.: US 8,672,817 B2
(45) Date of Patent: Mar. 18, 2014

(54) EXERCISE SYSTEM USING EXERCISE RESISTANCE CABLES

(75) Inventors: John Bowser, Las Vegas, NV (US); Kevin R. Lunau, Valley Center, CA (US); Michael S. Skahan, Escondido, CA (US)

(73) Assignee: VQ Actioncare, LLC, Irvine, CA (US)

( * ) Notice: Subject to any disclaimer, the term of this patent is extended or adjusted under 35 U.S.C. 154(b) by 139 days.

(21) Appl. No.: 13/192,386

(22) Filed: Jul. 27, 2011

(65) Prior Publication Data

US 2012/0190514 A1 Jul. 26, 2012

Related U.S. Application Data

(63) Continuation of application No. 12/581,869, filed on Oct. 19, 2009, now Pat. No. 7,998,042, which is a continuation-in-part of application No. 12/020,559, filed on Jan. 27, 2008, now abandoned, which is a continuation of application No. 11/062,063, filed on Feb. 18, 2005, now Pat. No. 7,322,907, which is a continuation-in-part of application No. 10/783,532, filed on Feb. 21, 2004, now Pat. No. 7,381,168.

(51) Int. Cl.
*A63B 21/00* (2006.01)

(52) U.S. Cl.
USPC ..... 482/130; 482/142; 482/121; 482/129

(58) Field of Classification Search
USPC ..... 482/130, 142, 121
See application file for complete search history.

(56) References Cited

U.S. PATENT DOCUMENTS

| | | | |
|---|---|---|---|
| 704,840 | A | 7/1902 | Korth |
| 1,279,120 | A | 9/1918 | Kellogg |

(Continued)

FOREIGN PATENT DOCUMENTS

| | | |
|---|---|---|
| DE | 201 00 566 U1 | 7/2001 |
| WO | WO84/04689 | 12/1984 |

OTHER PUBLICATIONS

Supplementary European Search Report (EP05713852) dated Oct. 5, 2010 (2 pages).

*Primary Examiner* — Jerome w Donnelly
(74) *Attorney, Agent, or Firm* — Lawrence N. Ginsberg

(57) ABSTRACT

An exercise chair for an exercise system. The exercise system is of a type that utilizes an exercise resistance cable apparatus of a type that includes an exercise resistance cable having a first end being connectable to an exercise chair, and; a hand-grip connected to a second end of the exercise resistance cable. The exercise chair includes: a) a chair frame; b) a first force directing means securely attached to the chair frame at a first selected location at approximately shoulder height level at the left side of the chair frame; c) a second force directing means securely attached to the chair frame at a second selected location at approximately shoulder height level at the right side of the chair frame; d) a third force directing means securely attached to the chair frame at a third selected location at approximately ankle height level at the right side of the chair frame; e) a fourth force directing means securely attached to the chair frame at a fourth selected location at approximately ankle height level at the left side of the chair frame; and, f) means for connecting the first end of a resistance cable to a selected position on the chair frame. The first, second, third and fourth force directing means provide a redirection of force applied by a user at the shoulder and ankle height levels for a selectable exercise using resistance cables.

13 Claims, 14 Drawing Sheets

(56) References Cited

U.S. PATENT DOCUMENTS

| | | | | |
|---|---|---|---|---|
| 2,267,376 | A | 12/1941 | Van Straaten | |
| 2,803,349 | A | 8/1957 | Talbot | |
| 3,606,321 | A | 9/1971 | Macoulis | |
| 3,677,543 | A | 7/1972 | Richardson | |
| 3,738,649 | A | 6/1973 | Miller | |
| 3,843,119 | A | 10/1974 | Davis | |
| 4,019,734 | A | 4/1977 | Lee | |
| 4,251,071 | A | 2/1981 | Norton | |
| 4,262,902 | A | 4/1981 | Dranselka | |
| 4,316,616 | A | 2/1982 | Boivin | |
| 4,390,177 | A | 6/1983 | Biran | |
| 4,572,501 | A | 2/1986 | Durham | |
| 4,720,099 | A | 1/1988 | Carlson | |
| 4,733,862 | A | 3/1988 | Miller | |
| 4,739,984 | A | 4/1988 | Dranselka | |
| 4,788,754 | A | 12/1988 | Fukumoto | |
| 4,838,547 | A | 6/1989 | Sterling | |
| 4,852,874 | A | 8/1989 | Sleichter, III | |
| 4,913,423 | A | 4/1990 | Farran | |
| 4,921,247 | A | 5/1990 | Sterling | |
| 5,029,850 | A | 7/1991 | van Straaten | |
| 5,044,633 | A | 9/1991 | Rice | |
| 5,080,353 | A | 1/1992 | Tench | |
| 5,112,287 | A | 5/1992 | Brewer | |
| 5,176,601 | A | 1/1993 | Reynolds | |
| 5,250,016 | A | 10/1993 | Higgins | |
| 5,324,243 | A | 6/1994 | Wilkinson | |
| 5,362,296 | A | 11/1994 | Wang | |
| 5,387,171 | A | 2/1995 | Casey | |
| 5,417,643 | A | 5/1995 | Taylor | |
| 5,470,298 | A | 11/1995 | Curtis | |
| 5,620,403 | A * | 4/1997 | Lundin | 482/96 |
| 5,674,167 | A | 10/1997 | Piaget | |
| 5,688,210 | A * | 11/1997 | Chou | 482/56 |
| 5,690,594 | A | 11/1997 | Mankovitz | |
| 5,769,556 | A | 6/1998 | Colley | |
| 5,779,601 | A | 7/1998 | Ish | |
| 5,833,582 | A | 11/1998 | Chen | |
| 5,899,836 | A | 5/1999 | Chen | |
| 5,921,900 | A | 7/1999 | Mankovitz | |
| 6,113,522 | A | 9/2000 | Fontenot | |
| 6,117,056 | A | 9/2000 | Cataldi | |
| 6,120,423 | A | 9/2000 | Mackey et al. | |
| 6,159,133 | A | 12/2000 | Shugg | |
| 6,245,001 | B1 | 6/2001 | Siaperas | |
| 6,319,179 | B1 | 11/2001 | Hinds | |
| 6,450,929 | B1 | 9/2002 | Markham | |
| 6,500,104 | B1 | 12/2002 | Rich | |
| 6,508,749 | B1 | 1/2003 | Broadwater | |
| 6,537,185 | B1 | 3/2003 | Hur | |
| 6,544,152 | B2 | 4/2003 | Rosati | |
| 6,752,745 | B1 * | 6/2004 | Davis | 482/72 |
| 6,770,014 | B2 | 8/2004 | Amore | |
| 6,840,894 | B2 | 1/2005 | Lerner | |
| 6,842,170 | B1 * | 1/2005 | Akins et al. | 345/173 |
| 6,872,170 | B2 | 3/2005 | Kuo | |
| 6,908,417 | B2 | 6/2005 | Jackson | |
| 6,926,237 | B2 | 8/2005 | Shereyk | |
| 6,981,932 | B1 | 1/2006 | Huang et al. | |
| 7,250,022 | B2 | 7/2007 | Dalebout et al. | |
| 2002/0077228 | A1 | 6/2002 | McBride | |
| 2002/0173412 | A1 | 11/2002 | Stearns | |
| 2004/0152572 | A1 | 8/2004 | Reitz | |
| 2004/0185991 | A1 | 9/2004 | Bowman | |
| 2004/0245836 | A1 | 12/2004 | Kropa | |
| 2005/0037905 | A1 | 2/2005 | Matos | |
| 2006/0019804 | A1 | 1/2006 | Young | |

* cited by examiner

EXERCISE SYSTEM USING EXERCISE RESISTANCE CABLES

CROSS REFERENCE TO RELATED APPLICATIONS

This is a continuation of U.S. Ser. No. 12/581,869 entitled "Exercise System Using Exercise Resistance Cables", filed Oct. 19, 2009 which is a continuation-in-part of U.S. Ser. No. 12/020,559, entitled "Exercise System Using Exercise Resistance Cables", filed Jan. 27, 2008, which is a continuation of U.S. Ser. No. 11/062,063, entitled "Exercise System Using Exercise Resistance Cables", filed Feb. 18, 2005 (U.S. Pat. No. 7,322,907), which is a continuation-in-part of U.S. Ser. No. 10/783,532, entitled "Exercise System Using Exercise Resistance Cables", filed Feb. 21, 2004 (U.S. Pat. No. 7,381,168).

BACKGROUND OF THE INVENTION

1. Field of the Invention

The present invention relates to exercise devices and systems and more particularly to an exercise system that utilizes removable exercise resistance cables that connect to activity bays of a support structure.

2. Description of the Related Art

The use of resistance cables for exercising is well known in the prior art. There are a multitude of different exercise systems and devices that have been previously disclosed or are currently in the market to supply the increasing demand for physical fitness. Many of these utilize resistance cables. For example, as far back as 1902, U.S. Pat. No. 704,840, issued to J. C. Korth et disclosed the use of an exercising machine employing elastic cords. U.S. Pat. No. 3,606,321, issued to N. D. Macoulis, discloses the use of elastic cords and a pole. U.S. Pat. No. 3,843,119, issued to R. P. Davis, discloses the use of a machine for exercising the arm muscles while the user stands upon a base.

U.S. Pat. No. 4,019,734, issued to W. Lee et al, discloses an elastic resistance type exercising device having a single length of latex rubber surgical tubing whose two ends are formed into sized handle loops by the use of leather fasteners. The handle loops are sleeved with vinyl tubing, and plugs are inserted in each of the open ends of tubing, that have twice passed through the fasteners to form the loops, to prevent the tubing from being pulled out of the fasteners. A user grasps the handle loops or secures them about his ankles and pulls against the elastic resistance. Two additional flexible sleeves are slidably mounted over the portion of the elastic tubing between the fasteners.

U.S. Pat. No. 3,677,543, issued to J. H. Richardson, discloses a pull type exercising device including a single piece of elastic tubing with loops formed at the respective ends of the tubing by s-shaped hooks that receive folded ends of the tubing. On each looped portion there is a sleeve. A slideable ring with an anchoring attachment is mounted on a tubular member. A user inserts an arm or leg in the loops and pulls his arm or leg and pulls on the anchored tubular member.

U.S. Pat. No. 6,508,749, issued to R. L. Broadwater, discloses a portable exercise device that includes an elastic cord with two ends. Each of the ends of the cord is received into opposite sides of a coupling. A clamp element is provided around a portion of the coupling. The clamp element compresses the coupling around the elastic cord to hold the cord in place inside the coupling. A handle may be provided around the coupling. The handle may be made from a resilient material so that the hand of the user may squeeze it. Additionally, end plugs may be provided for the handle to prevent the handle from slipping off the coupling.

U.S. Pat. No. 4,251,071, issued to Craig D. Norton, discloses an exercising device that comprises an elongated elastic cord with a foot-receiving loop formed at each end and a hollow hand grip with an axial bore extending from end to end with a longitudinally extending split permitting one or two lengths of the elastic rope to be inserted into the bore. The hand grip may be squeezed by the hand for causing the wall of the bore to frictionally grip the rope. The hand muscles are exercised by this squeezing action on the hand grip and the arm and shoulder muscles are exercised when the hand grip pulls on the rope to elongate it.

U.S. Pat. No. 4,852,874, issued to C. G. Sleichter, III et al, disclose an exercise device that includes an elastic loop having free ends spliced together, generally tubular handles disposed in diametrically opposed relation to one another on the loop and an elastic retainer sleeve surrounding intermediate portions of the loop between the handles. The device is conformable for use in performing a wide variety of exercises and for performing a selected number of repetitions of each exercise by grasping the handles and stretching against the resistance load of the loop and the retainer means. The handles can be grasped either by the hands or by a combination of hands and feet to perform various exercises or may be grasped between the feet or ankle portions to perform other exercises. In modified forms of the invention, one of the handles is made rigid so as to simulate a racquet or golf club handle to be used in practicing forehand and backhand strokes or to simulate the golf swing. The exercises may be performed effectively in either the standing, sitting or fully prone position. Other modified forms of invention include an anchor strap to facilitate practicing of the golf swing and a splice for joining together free ends of the loop into a unitary member.

U.S. Pat. No. 4,733,862, issued to J. V. Miller discloses an elastic resistance exerciser comprising an elongated elastic member having a loop formed at each end, a tubular handle slidably fit onto each loop of the elastic member, and a self-locking slider having three holes; with the elastic member slidably threaded through two of the holes and terminating the end of each loop in the third hole of each slider; the slider being adjustable along the elastic member, whereby the size of the loop may be varied by moving the slider with no tension on the loop, but self-locking by the application of tension to the loop. A preferred embodiment provides a band of flexible material attached approximately to the center of the length of an elastic member having more than one elastic element.

The above-mentioned patents each use elastic cable which functions as a resistance tool for exercising the body. In some cases the elastic/rubber cable is the only thing necessary to achieve the complete workout. In other cases a secondary product, such as a door, a handle or some sort of stationary device is required in order to use the product as designed.

There are a variety of patents that disclose exercise systems related to chairs. For example, U.S. Pat. No. 5,470,298, issued to J. L. Curtis; U.S. Pat. No. 5,417,643, issued to M. D. Taylor; U.S. Pat. No. 5,387,171, issued to M. E. Casey; U.S. Pat. No. 5,080,353, issued to L. Teach; U.S. Pat. No. 5,044,633, issued to B. A. Rice; U.S. Pat. No. 4,921,247, issued to J. F. Sterling; U.S. Pat. No. 4,838,547, issued to J. F. Sterling; U.S. Pat. No. 4,720,099, issued to R. B. Carlson; U.S. Pat. No. 1,279,120, issued to J. H. Kellogg; U.S. Publicn No. 2002/0173412 to K. W. Stearns; and, U.S. Publicn No. 2002/0077228 to R. W. McBride each disclose chair-related related exercise devices which have generally complicated designs.

U.S. Pat. No. 4,913,423, issued to M. R. Farran, discloses a furniture article, such as a seating article, for residential and office use that includes a frame housing, one or more exercise apparatus that are located in the armrest, the back and the seating base. The frame is selectively covered to provide the seating article with the appearance of a conventional furniture article used in the home or office. Each exercise apparatus employs a cable extending through the covering to communicate a source of resistive force from within the frame to a user outside of the frame. On the end of the cable outside of the covering is a handle or a foot stirrup by which the user pulls the cable out of the seating article. A cover conceals the handle or foot stirrup as well as the end of the cable while the exercise aspects of the furniture article are not being utilized. As in the other patents, discussed above, the Farran system is somewhat complicated. Furthermore, it is non-mobile and is limited in the amount of workout routines allotted.

U.S. Pat. No. 5,362,296, issued to L. Wang et al., discloses a chair mounting exercising unit includes two swinging arms having a bottom end fastened to either end of a substantially U-shaped locating rod being fixed to the back of a chair by a knob controlled lock device and a slotted side extension plate in the middle at an outer side movably hung on a screw bolt at either end of a horizontal frame on the back of the chair and a top end coupled with a pulley wheel assembly, and two elastic pull ropes respectively inserted through either pulley wheel assembly and fastened to either swinging arm and an opposite end coupled with a handle. With the increasing population of elderly persons and their desire for increased exercise there is a concomitant growing need for exercise equipment that the elderly can easily and efficiently use. The '296 patent system has two swinging arms each having a bottom end connected to either end of the locating rod and attached to either locating wheel. A mobile/moving system is not generally preferred for use with the elderly and is somewhat complicated. Positioning of the swinging arms requires time and labor. The present invention, as will be disclosed below, is designed for specific exercises and is excellent for users who have limited range of movement. It allows for a very stable environment minimizing movement in the setup process and eliminating the need for pulley arms. The present invention also allows the user to change cables without having to get up from the chair since all of the cable connections are set up on the sides of the chair versus the cables connections being on the back of the chair as disclosed in the '296 patent.

U.S. Pat. No. 5,674,167, issued to G. D. Piaget et al., discloses a strength training exercise apparatus includes a frame having an upright back rest, and a horizontal seat, and further includes opposing arm members pivotally mounted to the back rest. The arm members are movable through an arcuate range of motion, and include locking pins for selectively locking the arm members in desired angular positions. The apparatus still further includes a resistance assembly consisting of a fixed anchor mounted on the frame, a movable anchor which is movable relative to the fixed anchor, and a plurality of elastomeric resistance cords releasably secured between the movable anchor and the fixed anchor to provide resistance to movement of the movable anchor. A pull line is mounted on guide pulleys along the length of the arm members, and is received in association with the movable anchor whereby outward movement of the pull line with respect to the arm members causes movement of the movable anchor with respect to the fixed anchor. The exercise apparatus further consists of a leg member pivotally mounted to the seat, and a second resistance assembly including a second movable anchor coupled to the leg member, and a second plurality of elastomeric resistance cords secured between the fixed anchor and the second movable anchor for providing resistance to pivotal movement of the leg member. Seniors need ease of use when it involves getting on and off of the chair. The '167 patent system has opposing arm members pivotally mounted to the back rest. The arm members are movable through an arcuate range of motion and include locking pins for selectively locking the arm members in desired angular positions. While using the '167 device the user typically needs to get off of the chair in order to make the rear and lower connections. As noted above and as will be disclosed below, the exercise chair of the present invention allows the user to remain seated to make the necessary connections on the side of the chair.

U.S. Pat. No. 5,899,836, issued to P. Chen, discloses an exerciser includes a foot support secured in front of a base. A lever has a lower portion pivotally coupled to the base and has a bracket and a seat cushion pivotally secured on tops for allowing the seat cushion to be moved upward and downward. A tube is secured to the bracket for supporting one or more pulleys. The base has one or more pulleys secured to the front and the rear portions. One or more resilient members are engaged with the pulleys. A handle may be secured to the resilient member for conducting pulling exercises. The tube and a pulley may be moved upward and downward in concert with the seat cushion. The present invention does not have a secured foot rest and does not require the use of levers. The '836 design requires many steps for exercise setup and disassembly.

U.S. Pat. No. 6,117,056, issued to T. F. Cataldi, Jr. et al., discloses an exercise device attachable to the seat portion of a chair to resist forces applied in performing isotonic exercises. The device includes a strap securable to a chair and a seat pad positionable on the strap for supporting an exerciser and has D-rings secured to the strap and the seat pad for attachment of an elastic band for performing arm isotonic exercises with a hand band attachment. The device also includes a front flap securable at one end between the seat pad and strap and securable at an opposite end to a downwardly forward portion of the chair for performing leg isotonic exercises with an attached elastic band and an ankle strap attachment.

U.S. Pat. No. 6,159,133, issued to R. C. Shugg, discloses a seat mounted workout station system is provided including a seating assembly having a seat portion and a back portion. Also included is a frame mounted on a rear surface of the back portion of the seating assembly. Next provided is a plurality of tension members connected to the frame and further connected to cables which are routed through the frame via pulleys. Hand grips are connected to the cables for being gripped by a user.

As noted above, with the increasing population of elderly persons and their desire for increased exercise there is an associated growing need for exercise equipment that the elderly can easily and efficiently use. As will be disclosed below, the present invention satisfies these needs.

SUMMARY OF THE INVENTION

In one broad aspect, the present invention is an exercise chair for an exercise system. The exercise system is of a type that utilizes an exercise resistance cable apparatus of a type that includes an exercise resistance cable having a first end being connectable to an exercise chair, and; a handgrip connected to a second end of the exercise resistance cable. The exercise chair includes: a) a chair frame; b) a first force directing means securely attached to the chair frame at a first selected location at approximately shoulder height level at the left side of the chair frame; c) a second force directing means securely attached to the chair frame at a second selected location at approximately shoulder height level at the right side of the chair frame; d) a third force directing means securely attached to the chair frame at a third selected location at approximately ankle height level at the right side of the chair frame; e) a fourth force directing means securely attached to the chair frame at a fourth selected location at approximately ankle height level at the left side of the chair frame; and, f) means for connecting the first end of a resistance cable to a selected position on the chair frame. The first, second, third and fourth force directing means provide a redirection of force applied by a user at the shoulder and ankle height levels for a selectable exercise using a resistance cable.

The systems of the present invention are particularly advantageous for use with elderly persons. The present invention is easy to use, particularly for the elderly, because, assuming that the chairs are set up, the person merely picks up the desired cables and brings those cables to his or her workout station, attaches the cable(s) and is ready to work out.

Foldable chairs may be utilized that can be stored or kept in a variety of places such as in the home, hotels, retirement communities, health clubs, and physical therapy centers. Use of such foldable chairs provides a very mobile environment.

The present exercise system provides strength training without the stress of a pre-designed rigid machine. A person can take cables, connect them to the anchor assembly and exercise in accordance with his body height and size.

The chair may be integrated into a universal gym system and utilized with a variety of exercises.

Use of the present invention has several advantages over the prior art. It allows the user to easily change resistance levels and adjust resistant lengths—all from a seated position. The present inventive concepts provide safe, low impact exercise solutions that are easy to use and make the user feel better. The folding resistance chair provides a very convenient home exercise system. The chair allows the user to perform a full body workout from a safe, comfortable seated position. When seated, balance and stability is maintained as the arms, chest, shoulders, abdomen, back, and legs are exercised. The anchor assemblies ensure that the cable remains at the best angle for each exercise. The unique cable system offers a wide range of upper body and lower body exercises and provides resistance without use of heavy weights. When utilizing the resistance cables with the resistance chair, the user is provided with a safe, comfortable, secure and well rounded exercise routine.

The resistance chair has a pair of front legs that are each forwardly curved at an intermediate region thereof to enhance weight distribution for optimizing stability. This weight distribution design ("WDD") provides a secure and safe structure particularly advantageous utilizing recommended balance bar exercise routines.

BRIEF DESCRIPTION OF THE DRAWINGS

The same elements or parts throughout the figures of the drawings are designated by the same reference characters, while equivalent elements bear a prime designation.

DETAILED DESCRIPTION OF THE INVENTION

Figure 1:
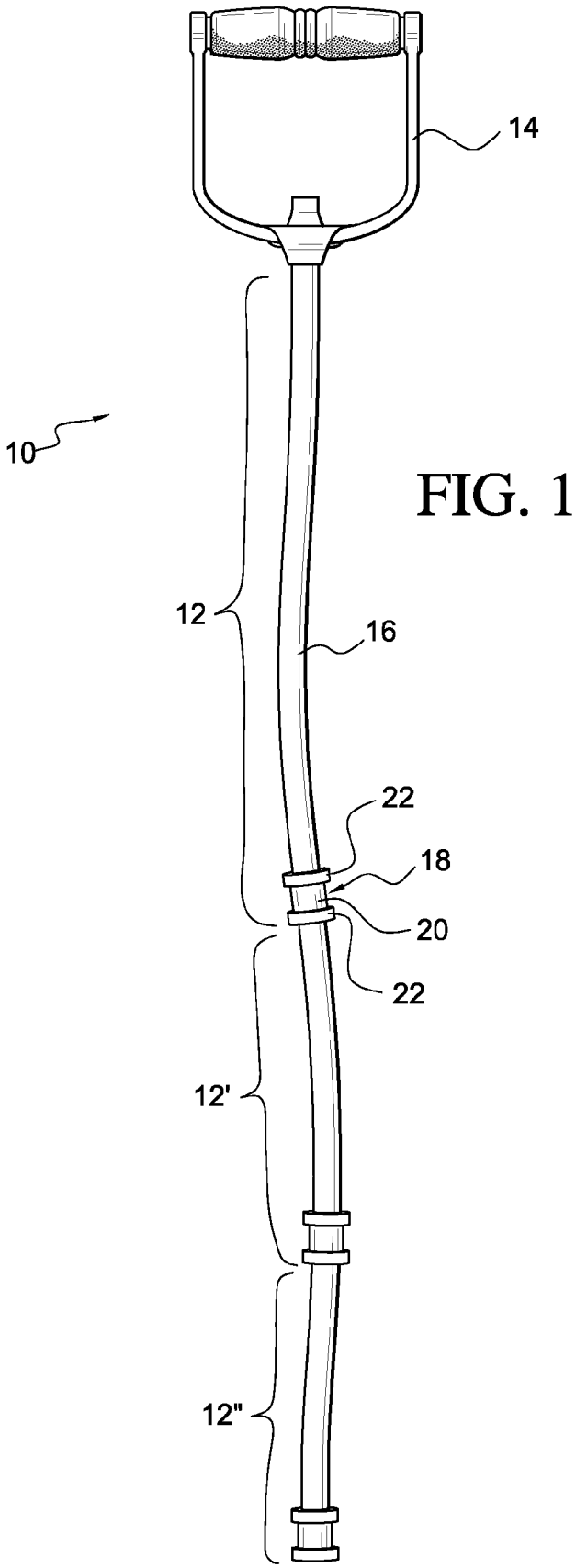
FIG. 1 is a perspective view of a first embodiment of the exercise resistance cable apparatus of the present invention.

Referring now to the drawings and the characters of reference marked thereon, FIG. 1 illustrates a first embodiment of the exercise resistance cable apparatus of the present invention, designated generally as 10. The exercise resistance cable apparatus 10 includes a first cable/anchor module 12 and a handgrip 14. Additional cable/anchor modules 12', 12" are connected to the first cable/anchor module 12. The cable/anchor modules 12 are serially connected to provide a desired user length and resistance.

Each cable/anchor module 12 includes an elastic exercise resistance cable 16 which is connected at an end thereof to a cable expansion anchor 18. Each cable expansion anchor 18 is preferably spool-shaped and includes a shaft 20 and two longitudinally spaced radially extending flanges 22.

The additional cable/anchor modules 12', 12", . . . 12" are connected to provide the correct user length and resistance commensurate with the user's strength. Generally, the resistance is tied to the thickness or grade of materials used for the cable. Preferably, a varying degree of cables are implemented for use with this invention. They may be categorized, for example, in terms of light, medium and heavy resistance. Or, they may be more particularly be referred to relative to their resistance in pounds, i.e., Light—5 to 15 lbs of resistance, Medium—16 to 30 lbs of resistance. Heavy—31 to 45 lbs of resistance.

The elastic exercise resistance cables 16 are preferably formed of rubber; however, they may be formed of other suitable stretchable materials.

The cable expansion anchors 18 are preferably formed of hardened rubber; however, they may be formed of other strong materials.

Figures 2, 3, 4:
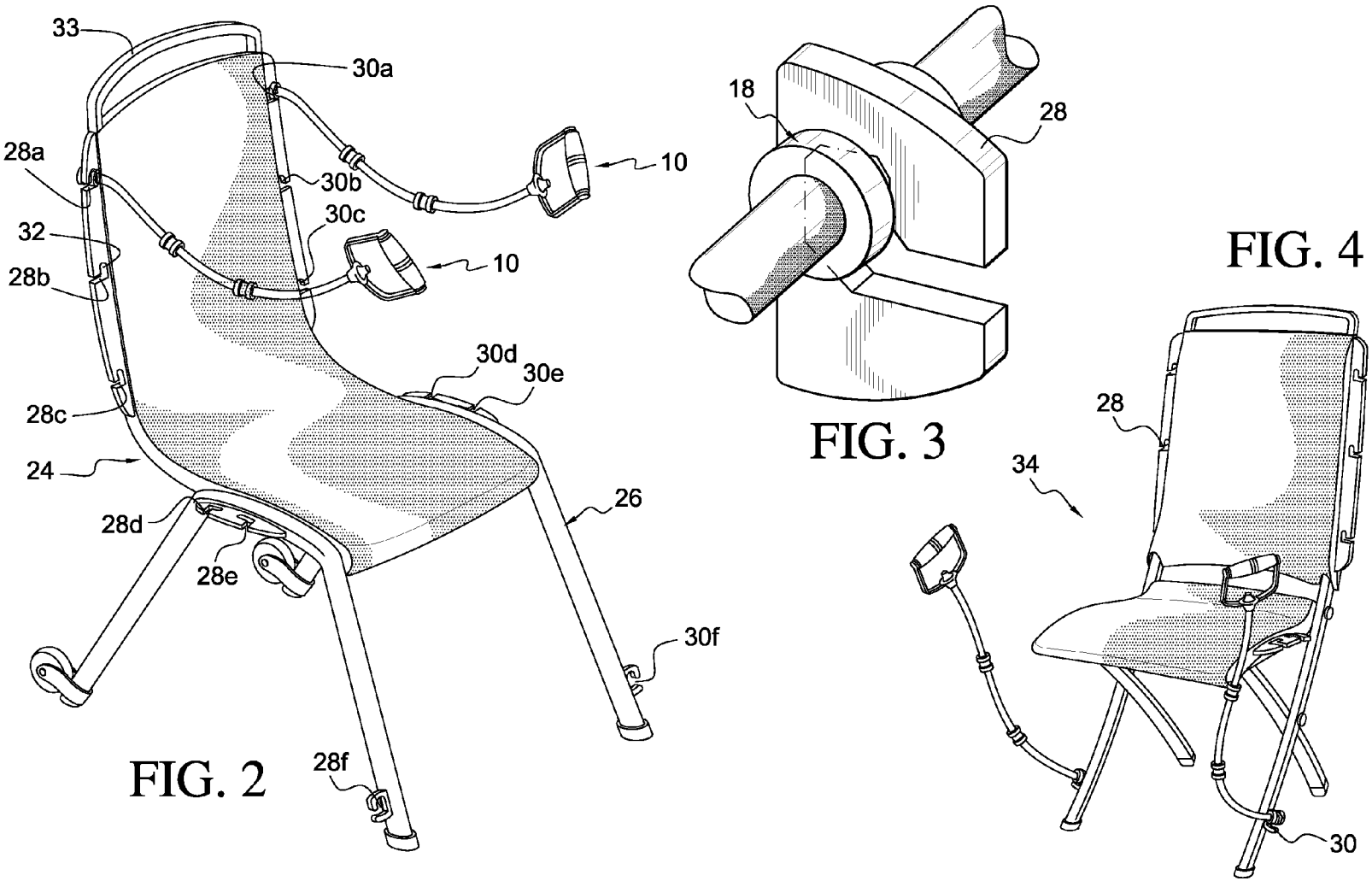
FIG. 2 is a perspective view of an exercise chair of the first embodiment of the present invention with two exercise resistance cable apparatus' shown attached thereto.
FIG. 3 is an enlarged perspective view of a cable expansion anchor engaged with an activity bay of the support structure.
FIG. 4 is a perspective view of an alternate version of an exercise chair which is foldable.

Referring now to FIG. 2, the exercise resistance cable apparatus 10 is shown having been attached to an exercise chair, designated generally as 24. The chair 24 includes a chair frame 26 and a number of activity bays 28*a-f* and 30*a-f*. Each activity bay 28, 30 includes a slot 32 which is preferably L-shaped. The slots are positioned at desired locations on the chair frame 26 which are associated with designated exercises. The activity bays 28 are strategically placed on the resistance chairs to allow comfortable, ergonomically friendly and safe exercise routines. A shaft 20 of the chosen expansion anchor 18 is friction fitted within a desired slot 32. The slots 32 are oriented in the reverse direction of the applied pulling force for a designated exercise routine. Although FIG. 2 shows the resistance cables as projecting out horizontally, this is for the purpose of more clearly showing the features of the invention. The resistance cables are typically much more flaccid than as shown in this figure. (This is also the case with some of the illustrations of these cables in subsequent figures.)

Various exercise routines are available at the activity bays 28:

A. Activity bays 28*a*, 30*a:* i) Abdominal crunches—Stomach—Abdominal, Oblique.

iii) Triceps press—Arms—Triceps, Flexor Carpi Radials, Palmaris Longus iii) Decline Press—Chest—Pectoralis Major, Latissimus Dorsi iv) Chest Press—Chest—Pectoralis Major, Latissimus Dorsi B. Activity bays 28*b*, 30*b:* i) Chest Fly—Chest—Pectoralis Major, Latissimus Dorsi

C. Activity bays 28*c*, 30*c:* i) Incline Press—Chest—Pectoralis Major, Latissimus Dorsi

D. Activity bays 28*d*, 30*d:* i) Triceps Press—Arms—Triceps, Flexor Carpi Radials, Palmaris Longus ii) Overhead Press—Shoulders—Anterior Deltoid, Middle Deltoid, Triceps E. Activity bays 28*e*, 30*e:* i) Triceps Press—Arms—Triceps, Flexor Carpi Radials, Palmaris Longus ii) Overhead Press—Shoulders—Anterior Deltoid, Middle Deltoid, Triceps F. Activity bays 28*f*, 30*f:* i) Arm Curls—Arms—Biceps/Forearms-Extensor Digitorum, Brachioradialis ii) Upright Rows—Shoulders—Anterior Deltoid, Middle Deltoid iii) Lateral Raises—Shoulders—Anterior Deltoid, Middle Deltoid iv) Front Raises—Shoulders—Anterior Deltoid, Middle Deltoid v) Rear Delts—Back—Latissimus Dorsi, Teres Major, Rear Deltoid vi) Neck Rows—Back and Neck—Middle and Lower Trapezius, Platysma Still referring to FIG. 2, the top part of the seat back preferably includes a balance bar section 33. The balance bar section 33 provides the capability of performing the following exercises:

i) Squats—Legs—Gluteus Maximus, Satorius, Vastus Medialis, Vastus Lateralis, Rectus Femoris ii) Balancing—Body—Mental and muscular and body control iii) Stretching—Body—Range allows for stretching of various upper and lower muscle groups iv) Calf Raises—Gastrocnemius Muscle both Medial and Lateral heads Referring now to FIG. 3, a cable expansion anchor 18 is shown engaged with an activity bay 28 of a support structure. The cable expansion anchor 18 is securely friction fit within the activity bay 28 so as to allow minimal movement.

Referring now to FIG. 4 implementation of the principles of the present invention are shown with respect to a folding chair, designated generally as 34. As in the non-folding version, the folding chair 34 includes a plurality of activity bays 28, 30. Folding chairs 34 provide for convenient storage in a side-by-side manner while the non-folding embodiments 24 conveniently stack upon each other.

Figure 5:
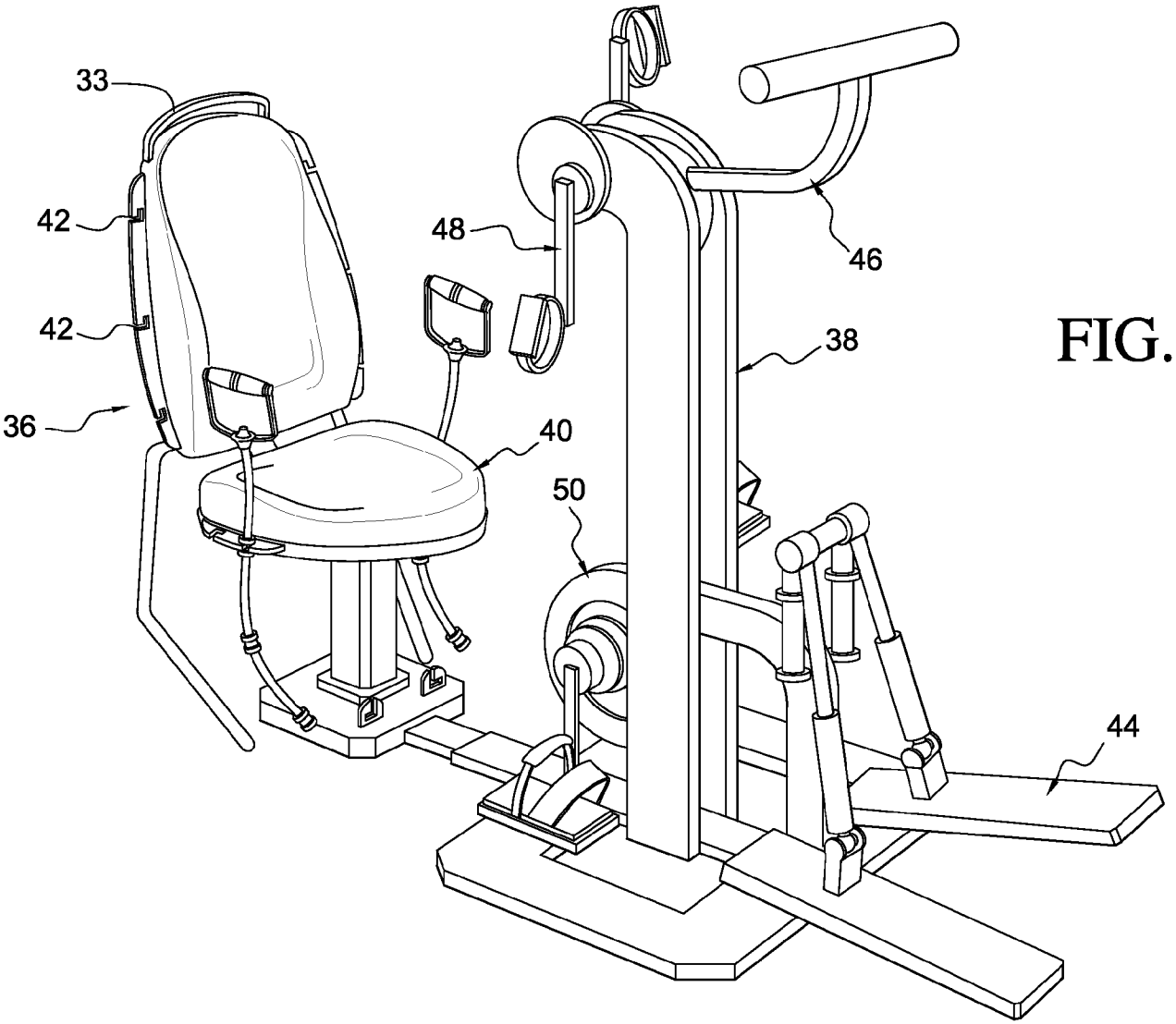
FIG. 5 perspective view of a first embodiment of universal exercise gym system in accordance with the principles of the present invention.

Referring now to FIG. 5, implementation of the principles of this invention is shown relative to a universal gym exercise system, designated generally as 36. This universal gym exercise system 36 includes a main frame, designated generally as 38, and a number of exercise components associated with the main frame. One of these components includes a support structure, i.e. exercise chair 40, having activity bays 42. Other components of the exercise system 36 may include a stepper assembly 44, a handle assembly 46, an ergometer 48, and a step rotator assembly 50. There is a wide variety of exercise equipment that can be connected to the frame 38, for example, a rowing machine or elliptical machine.

Figure 6:
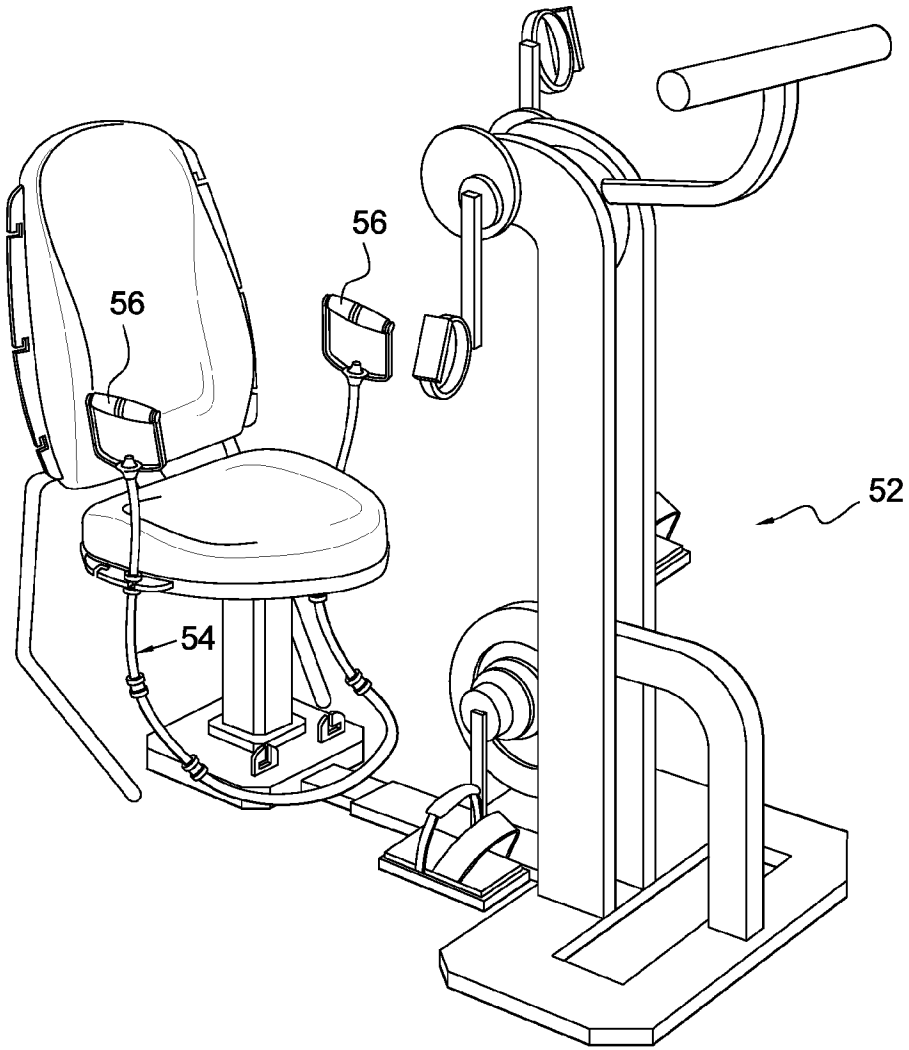
FIG. 6 is a perspective view of an alternate universal exercise gym system without a stepper assembly but still utilizing the resistance cable setup of the first embodiment.

Referring now to FIG. 6, another embodiment of a universal gym is illustrated, designated generally as 52. Universal gym 52 is similar to that of FIG. 5; however, the stepper assembly 44 is omitted. The universal gyms disclosed in this patent application will be marketed and distributed under the trademark Resistance Gym™

Although the present invention as thus far been described with reference to an exercise resistance cable apparatus having a handle at one end, FIG. 6 illustrates an alternate embodiment, designated generally as 54, in which the handles 56 are provided at both ends of the exercise resistance cable apparatus 54.

Figure 7:
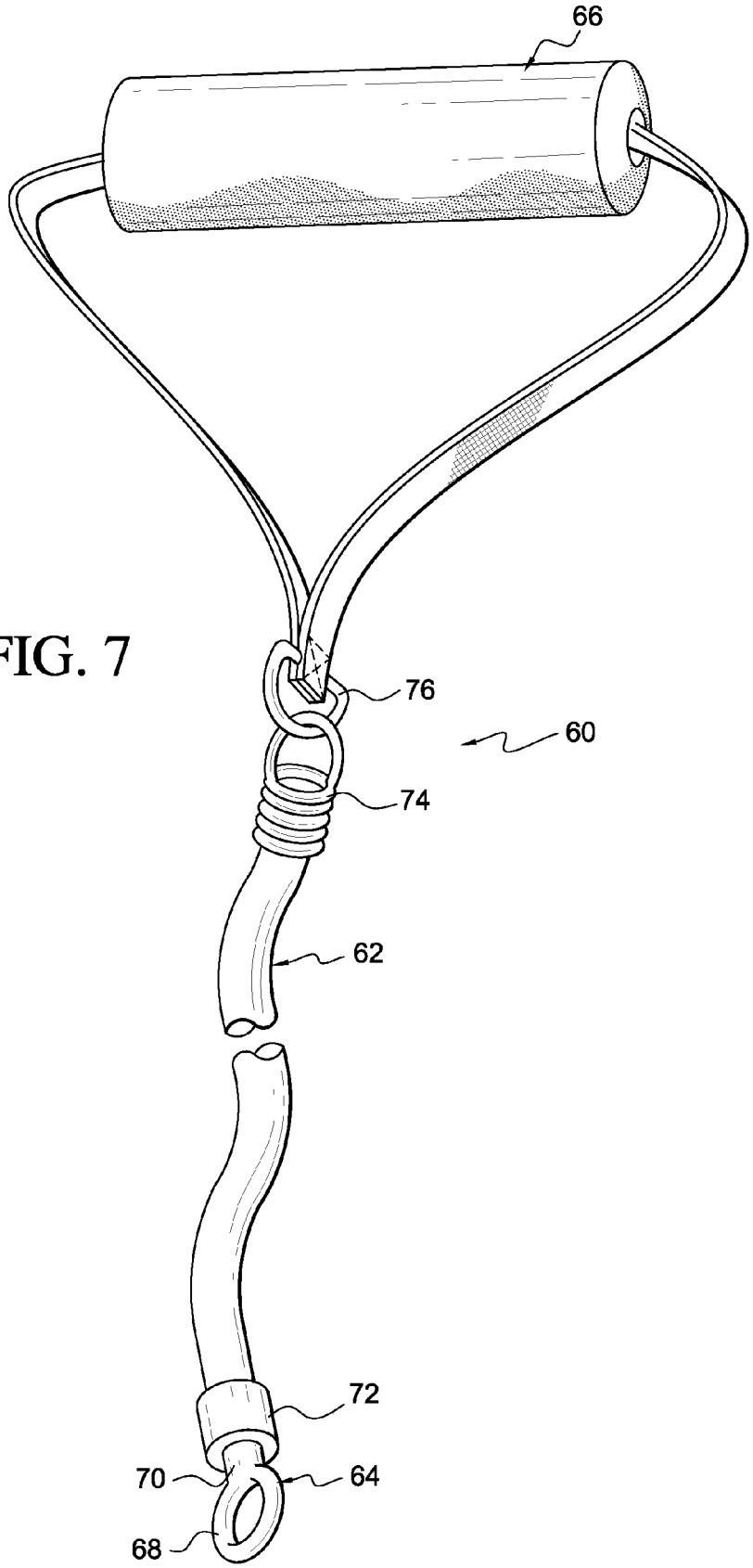
FIG. 7 is perspective view of another embodiment of the exercise resistance cable apparatus of the present invention in which a cable anchor ring securely connected to a first end of the elastic exercise resistance cable, that engages a pulley assembly of a support structure, is used to connect to an anchor assembly of the support structure.

Referring now to FIG. 7, another embodiment of the exercise resistance cable apparatus is illustrated, designated generally as 60. In this embodiment, the exercise resistance cable apparatus 60 includes an elastic exercise resistance cable, designated generally as 62; a cable anchor ring, designated generally as 64, securely connected to a first end of the elastic exercise resistance cable 62; and, a handgrip, designated generally as 66, connected to a second end of the elastic exercise resistance cable 62. The exercise resistance cable 62, as noted relative to the previous embodiment, may be formed of rubber or other suitable stretchable materials. These exercise resistance cable apparatuses will be sold and marketed under the trademark Resistance Anchor Cable™.

The cable anchor ring 64 includes a circular section 68 and an integral extension 70 extending from the circular section 68. The integral extension 70 is securely attached to the first end of the elastic exercise resistance cable 62. Although the cable anchor ring 64 is shown as having a circular section 68 obviously other shapes for the ring can be used as long as it provides a suitable connection as described below. A cover 72 is preferably positioned around the integral extension 70 and the portion of the first end of the elastic exercise resistance cable 62 in the vicinity of the integral extension 70. The cover 72 may be formed of plastic and be color coded to define a selected level of resistance. The hand grip 66 preferably includes a spring 74 and D-ring 76 connection.

Figure 8:
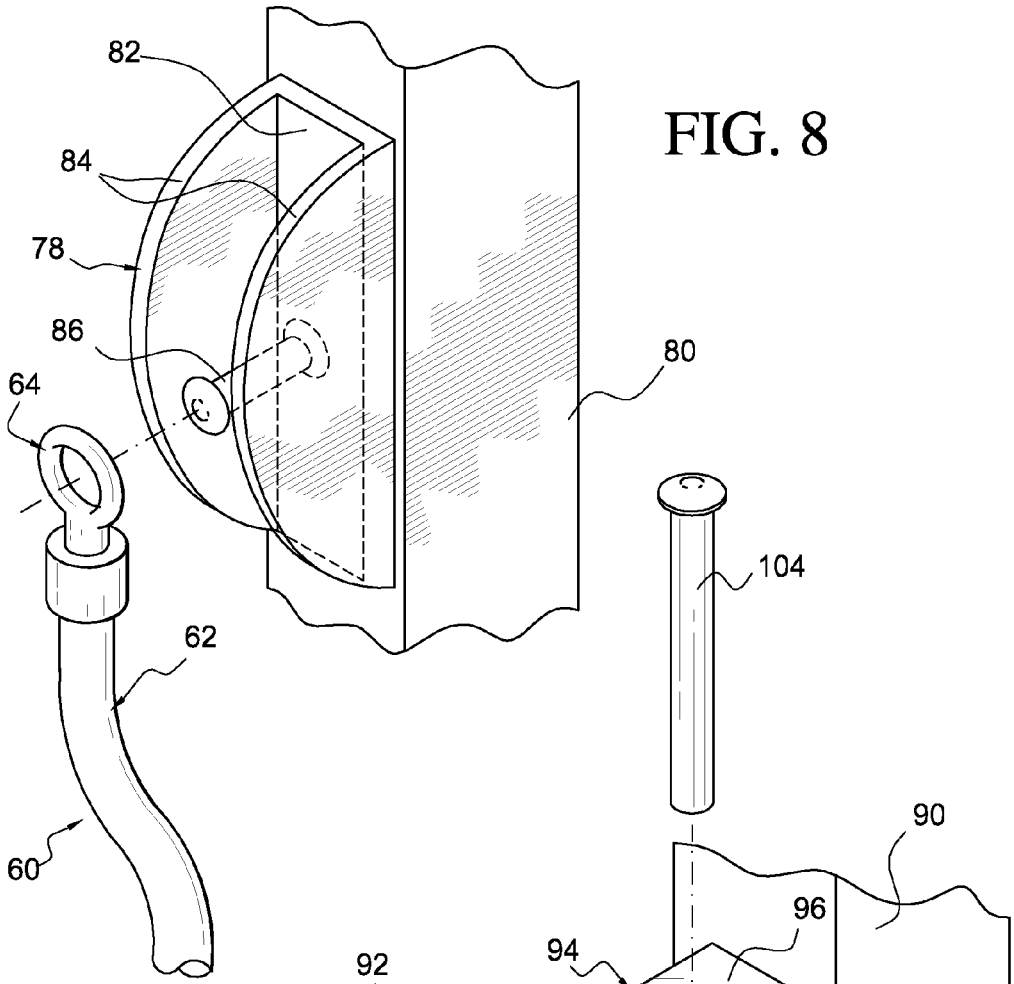
FIG. 8 is an enlarged perspective view of the anchor assembly of the FIG. 7 embodiment showing the resistance cable detached and adjacent to that anchor assembly.

Referring now to FIG. 8, the cable anchor ring 64 of the exercise resistance cable apparatus 60 connects to an anchor assembly, designated generally as 78, of a support structure 80. The anchor assembly 78 includes a base 82 securely attached to the support structure 80 at a selected anchor assembly location, as will be discussed in detail below.

A pair of spaced parallel support rails 84 extends from respective sides of the base 82 and serves as a guideway for the elastic exercise resistance cable 62. A cable locking pin 86 extends from the base 82 for securing the cable anchor ring 64.

Figure 10:
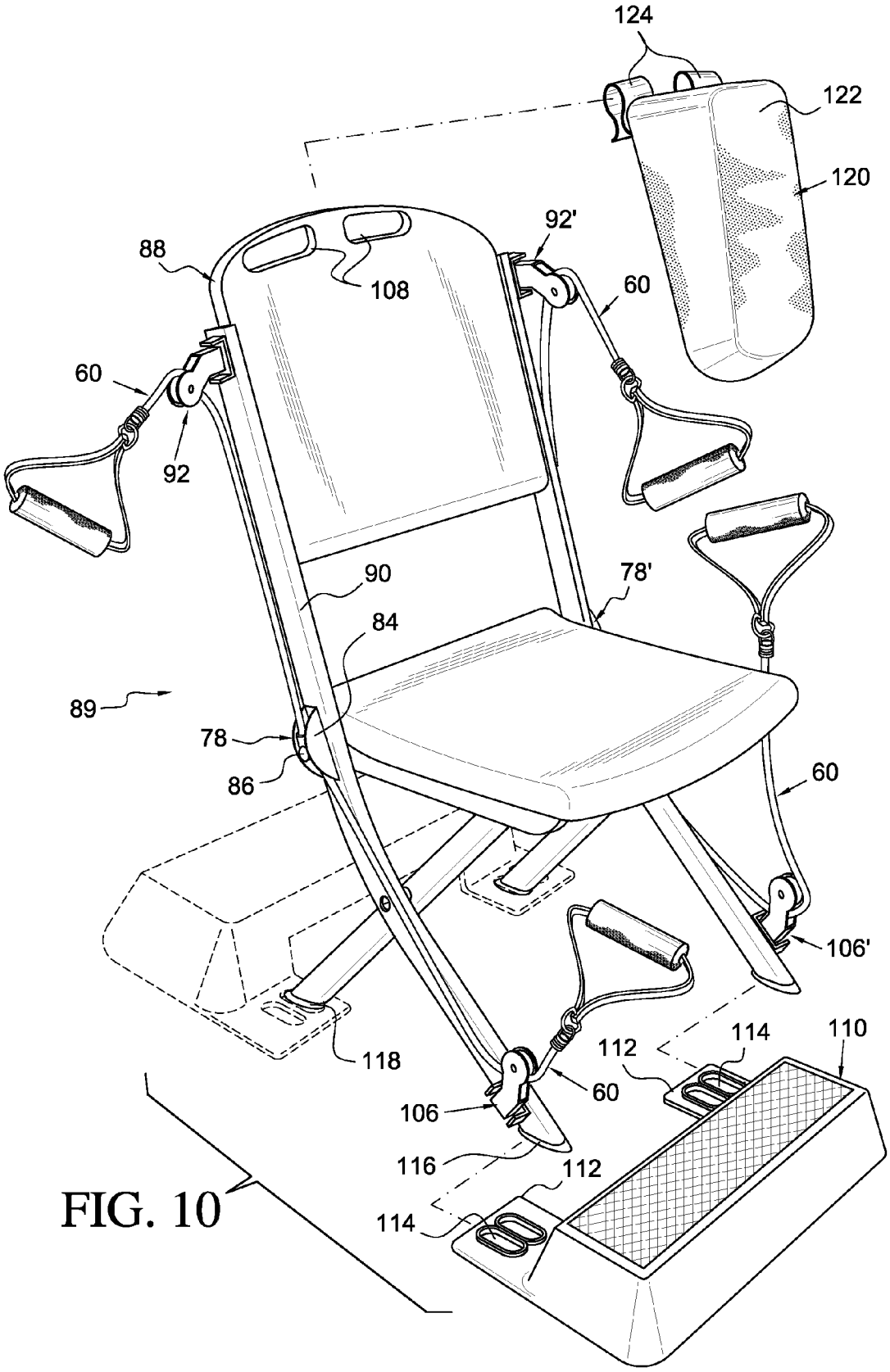
FIG. 10 is an enlarged perspective view of an exercise chair with four exercise resistance cable apparatus' shown attached, the chair including a balance bar.

Referring now to FIG. 10, application of the exercise resistance cable apparatus 60 to a support structure comprising a chair, designated generally as 88, is illustrated. In this exercise system, designated generally as 89, the chair frame 90 of the chair 88 has a first anchor assembly 78 secured thereto at approximately seat level on a first side of the chair frame and second anchor assembly 78' secured thereto at approximately seat level on a second side of the chair frame 90. The support rails 84 are directed toward a first pulley assembly, designated generally as 92, positioned at approximately shoulder height level on the first side of the chair frame 90.

Figure 9:
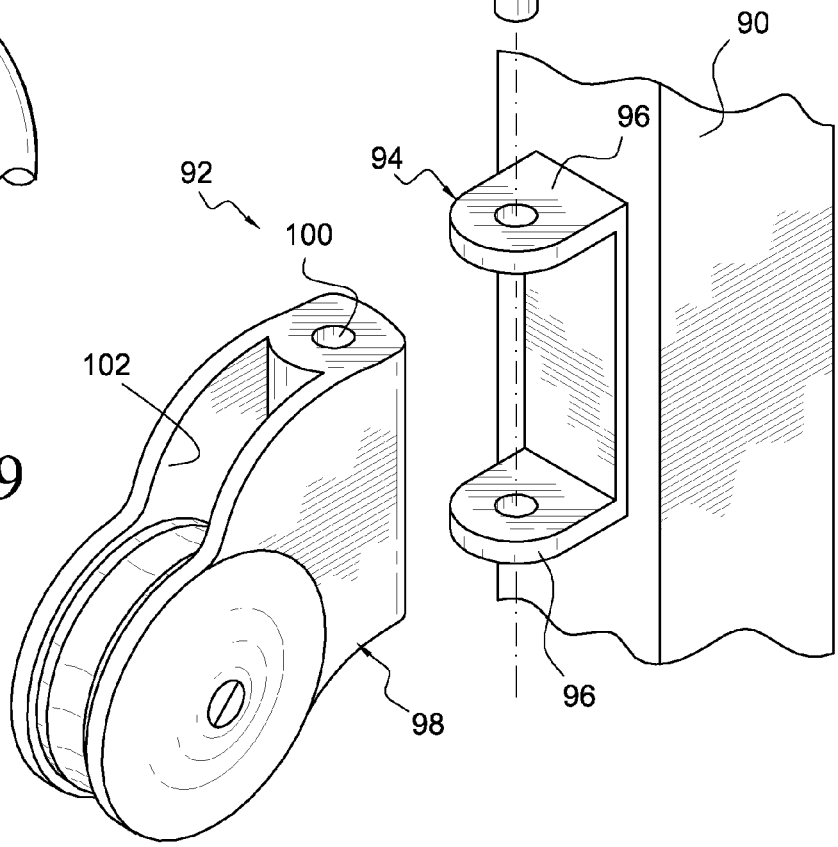
FIG. 9 is an exploded perspective view of a pulley assembly in accordance with the principles of the present invention.

Referring now to FIG. 9, an exploded view of the pulley assembly 92 is illustrated. The pulley assembly 92. The pulley assembly 92 includes a u-bracket 94 secured to the support structure 90. The u-bracket 94 has a pair of arms 96 having respective u-bracket openings therein. A pulley 98 has a pulley opening 100 extending through a first portion thereof. The pulley 98 has a second portion having an activity bay opening 102 formed therein defining an activity bay for receiving a resistance cable 62. A pulley pin 104 extends through the pulley opening 100 and through the u-bracket openings 96 to secure the pulley 98 to the support structure 90.

Referring again now to FIG. 10, it can be seen that the chair 88 includes a second pulley assembly 106 positioned at approximately ankle height level on the first side of the chair frame 90, a third pulley assembly 92' positioned at approximately shoulder height level on the second side of the chair frame 90 and a fourth pulley assembly 106' positioned at approximately ankle height level on the second side of the chair frame. During use, the operator can connect the resistance cables in the desired orientation. Each elastic exercise resistance cable is directed through an associated activity bay of its associated pulley assembly and ultimately attached, via its cable anchor ring, to the cable locking pin of that anchor assembly.

Figure 11:
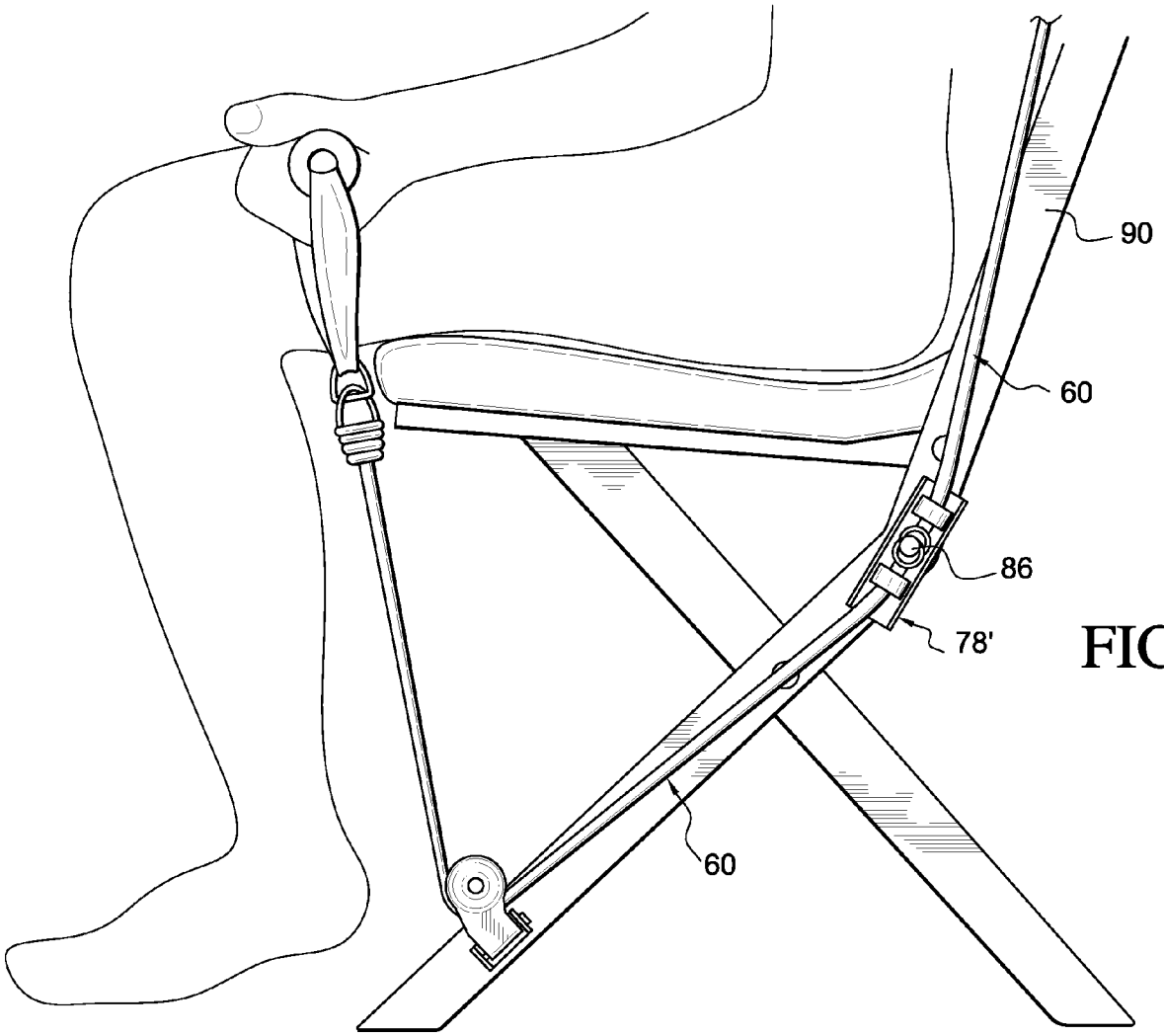
FIG. 11 is a left side perspective view of the exercise chair of FIG. 10 with a user shown using the lower exercise resistance cable apparatus.

As most clearly seen in FIG. 11 both of the exercise resistance cable apparatus 60 on each side of the chair share a common anchor assembly 78.

Various exercise routines are available using the upper and lower pulleys, as follows:

A. Upper Pulley Activity bays 92, 92':

i) Abdominal crunches—Stomach—Abdominal, Oblique.

iii) Triceps press—Arms—Triceps, Flexor Carpi Radials, Palmaris Longus iii) Decline Press—Chest—Pectoralis Major, Latissimus Dorsi iv) Chest Press—Chest—Pectoralis Major, Latissimus Dorsi v) Chest Fly—Chest—Pectoralis Major, Latissimus Dorsi vi) Incline Press—Chest—Pectoralis Major, Latissimus Dorsi vii) Triceps Press—Arms—Triceps, Flexor Carpi Radials, Palmaris Longus viii) Overhead Press—Shoulders—Anterior Deltoid, Middle Deltoid, Triceps B. Lower Pulley Activity bays 106, 106':

i) Arm Curls—Arms—Biceps/Forearms-Extensor Digitorum, Brachioradialis ii) Upright Rows—Shoulders—Anterior Deltoid, Middle Deltoid iii) Lateral Raises—Shoulders—Anterior Deltoid, Middle Deltoid iv) Front Raises—Shoulders—Anterior Deltoid, Middle Deltoid v) Rear Delts—Back—Latissimus Dorsi, Teres Major, Rear Deltoid vi) Neck Rows—Back and Neck—Middle and Lower Trapezius, Platysma Thus, the activity bays are strategically placed on the resistance chairs to allow comfortable, ergonomically friendly and safe exercise routines.

The top part of the seat back preferably includes a balance bar section 108. The balance bar section 108 provides the capability of performing the following exercises:

i) Squats—Legs—Gluteus Maximus, Satorius, Vastus Medialis, Vastus Lateralis, Rectus Femoris ii) Balancing—Body—Mental and muscular and body control iii) Stretching—Body—Range allows for stretching of various upper and lower muscle groups iv) Calf Raises—Gastrocnemius Muscle both Medial and Lateral heads As shown in FIG. 10, this exercise chair 88 will be marketed and distributed under the trademark Resistance Chair™.

A stepper 110 may be utilized with the exercise chair 88. The stepper 110 includes flanges 112 that have openings 114 for engaging the feet 116 of the chair 88. When positioned on the front feet 116 the chair effectively locks the stepper 110 in place to prevent slippage and obviate potential injuries. The stepper 110 positions the person in a beneficial posture for increased balance and stability. This stepper 110 will be marketed and distributed under the trademark Health Step™.

When positioned on the rear feet 118, as shown by the phantom lines, the stepper 110 serves as a secure platform for calf raises, squats, balancing and stretching.

A back support assembly 120 includes a back support 122 and clips 124 for engaging the balance bar section 108 of the chair frame 76. This back support assembly 120 will be marketed and distributed under the trademark PostureProp™. The back support assembly 120 positions the user forwardly to provide him with a beneficial posture and positioning on the chair 88. In this embodiment, the balance bar section 108 is part of the chair frame 90. As in the explanation above, the balance bar section 108 provides the capability of performing various exercises.

The front legs of the chair frame 90 are each forwardly curved at an intermediate region thereof to enhance weight distribution for optimizing stability. This weight distribution design ("WDD") provides a secure and safe embodiment of the structure while utilizing recommended balance bar exercise routines. The need for enhanced stability is imperative for exercise equipment intended for senior use. Generally, senior citizens may not have the balancing capabilities that younger persons have. Furthermore, they are more susceptible to injury from a fall.

Figure 12:
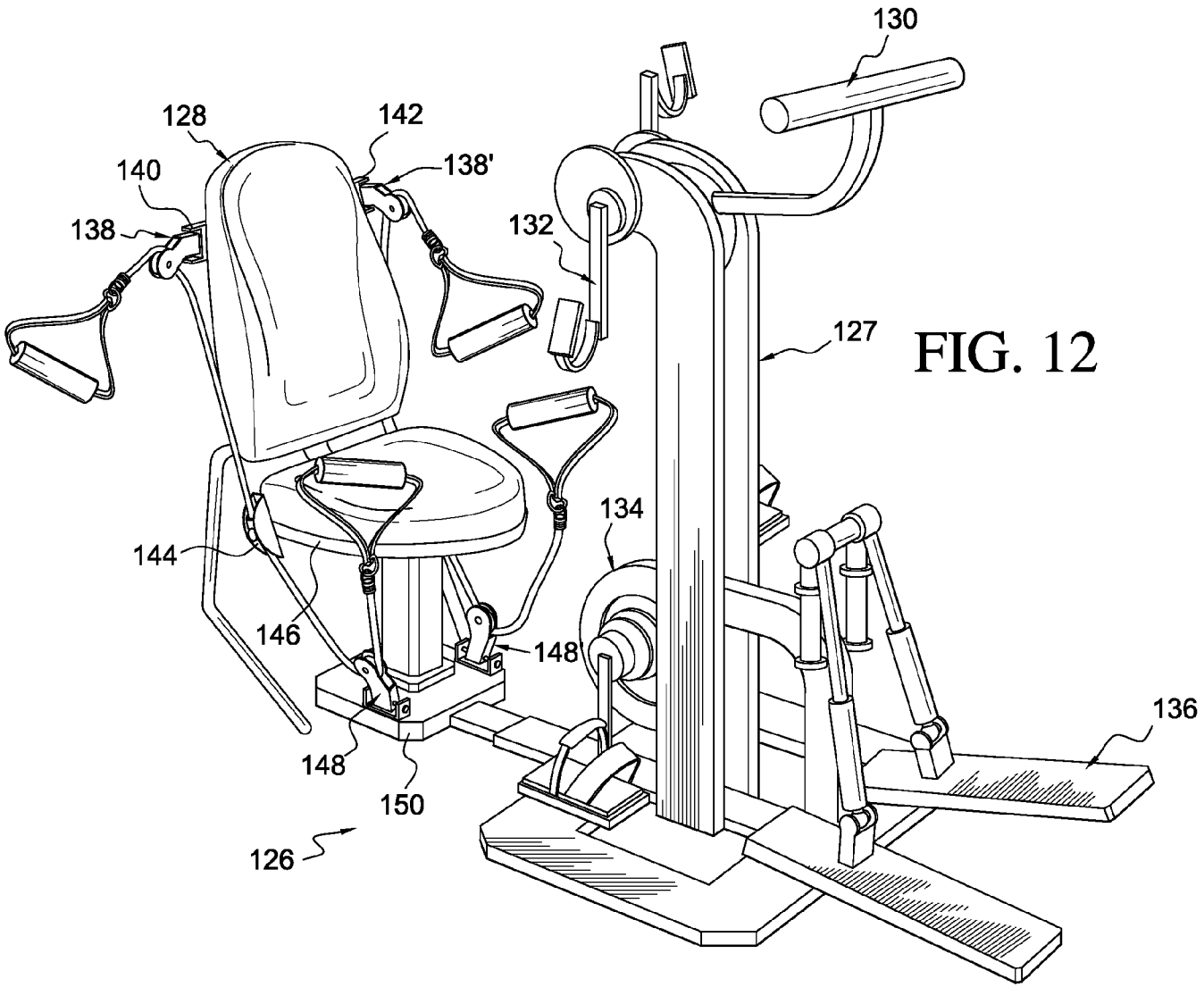
FIG. 12 is a perspective view of a universal exercise gym system in accordance with the principles of the present invention, utilizing the exercise resistance cable apparatus of FIG. 7.

Referring now to FIG. 12, implementation of the principles of this invention is shown relative to a universal gym exercise system, designated generally as 126. As in the FIG. 5 embodiment, this system includes a main frame, designated generally as 127, and a number of exercise components associated with the main frame. One of these components includes a support structure, i.e. exercise chair 128, having activity bays at various positions. Other components of the exercise system 126 may include a handle assembly 130, an ergometer (i.e. handbike) 132, and a recumbent bike assembly 134. There is a wide variety of exercise equipment that can be connected to the frame 127, for example, a rowing machine, elliptical machine 136, a stepper, or e.g., a number of leisure activity sporting enhancements concepts such as golf or tennis swing strengtheners.

Activity bays 138, 138' are positioned on respective extensions 140, 142 of the seat back frame section of the exercise chair 128. Anchor assembly 144 and its associated anchor assembly (not visible in this figure) on the other side of the chair are positioned on the seat bottom frame section 146 of the chair. Activity bays 148, 148' are located on the pedestal section 150 of the chair 128.

Figure 13:
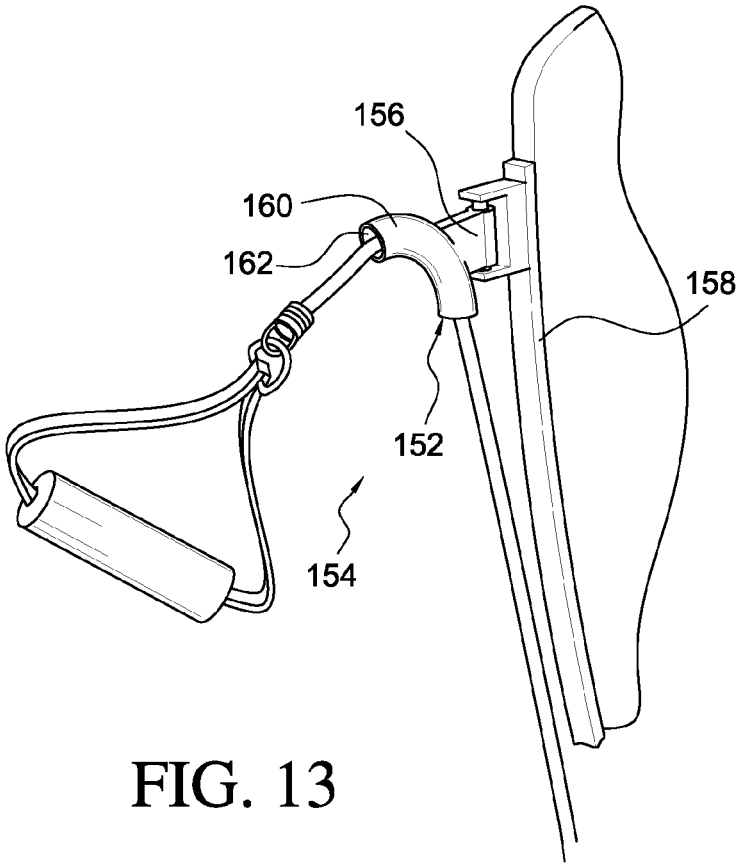
FIG. 13 is a perspective view of the exercise system being implemented using rotatable elbow assemblies.

Instead of using a pulley assembly to direct the force in the desired direction other types of force directing means may be utilized instead. Referring now to FIG. 13, force directing means comprising rotatable elbow assemblies, designated generally as 152 are utilized, in an exercise system, designated generally as 154. Each rotatable elbow assembly 152 includes a swivel housing 156 securely and rotatably connected to the chair frame 158. An elbow element, i.e. bent tubing element 160, is secured to the swivel housing 156 for containing an interior channel 162 with a low friction surface for slidable engagement of a resistance cable. The low friction surface may be, for example, polished metal.

Figure 14:
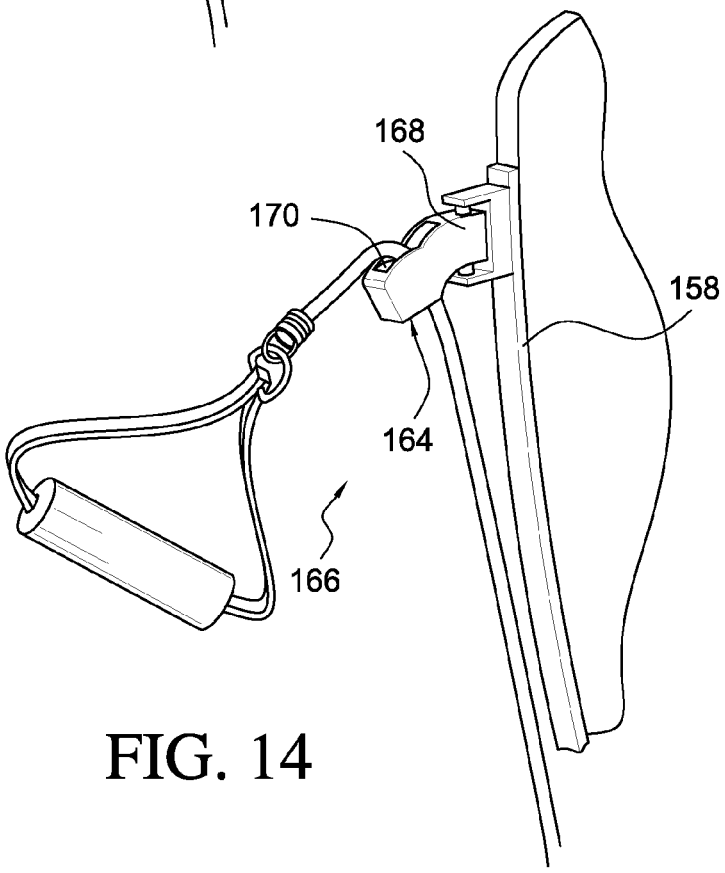
FIG. 14 is a perspective view of the exercise system being implemented using rotatable swivel housings and elbow elements.

Referring now to FIG. 14, an alternative embodiment of a rotatable elbow assembly is illustrated, designated generally as 164, in a system designated generally as 166. The rotatable elbow assembly 164 includes a swivel housing 168 securely and rotatably connected to the chair frame. An elbow element 170 is secured to the swivel housing 168 that has the interior channel with a low friction surface. (As used herein the term "secured" is defined broadly to include the integral forming of the elbow element 170 with the swivel housing 168, as shown in the Figure.) The low friction surface may comprise an acetal resin such as DuPont™ DELRIN® acetal resin, DuPont™ TEFLON® PTFE, acetal resin, or nylon.

Although not shown in FIGS. 13 and 14 the force directing means on each side of the chair may share the same anchor assembly.

Figure 15:
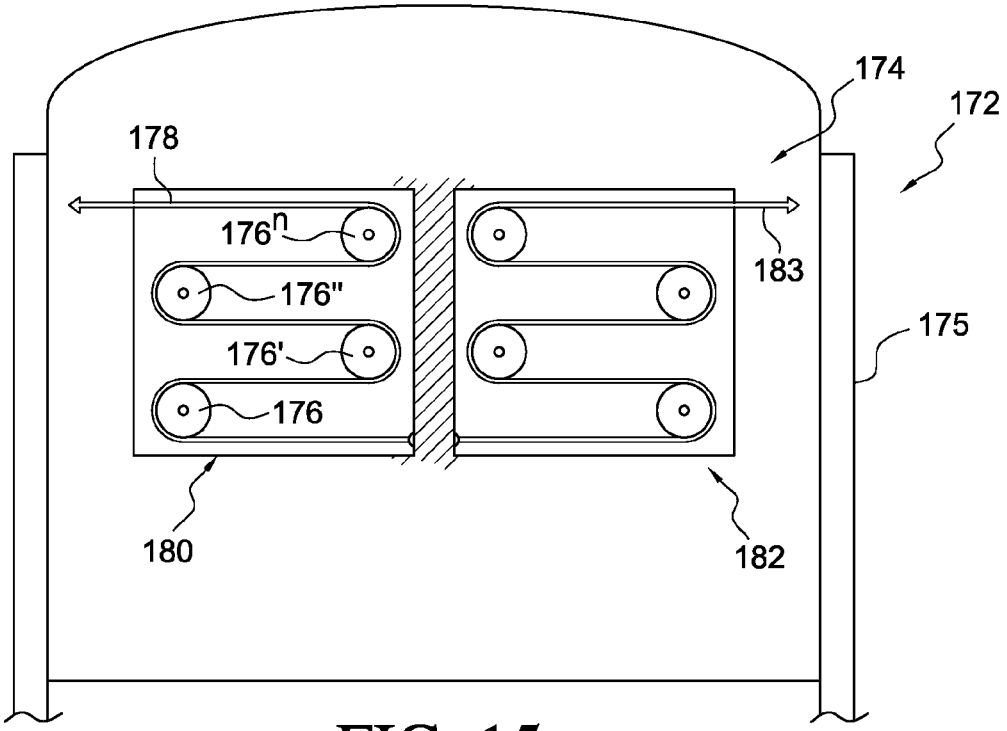
FIG. 15 is a schematic illustration of an alternative embodiment of the exercise system utilizing seat back subassemblies with rotatable guide wheels, in this embodiment the seat back subassemblies being rigidly attached to the chair frame.

Referring now to FIG. 15, another embodiment of the exercise system is illustrated, designated generally as 172. In this embodiment the chair includes a seat back assembly 174 connected to the chair frame 175. The assembly seat back assembly 174 includes a left set of spaced rotatable guide wheels 176, 176', . . . 176". Each guide wheel 176 has a groove for supporting an exercise resistance cable 178. The left set includes a left proximal rotatable guide wheel 176 providing a first position for supporting an exercise resistance cable 178; and, a left terminal rotatable guide wheel 176" at approximately shoulder height level at the left side of the chair frame for providing a terminal position for supporting said exercise resistance cable.

The left set of spaced rotatable guide wheels 176, 176', . . . 176" are supported by a left seat back subassembly, designated generally as 180 and the right set of spaced rotatable guide wheels are supported by a right seat back subassembly, designated generally as 182. The left seat back subassembly 180 and the right seat back subassembly 182 are rigidly attached to the chair frame 176. In this embodiment the rotatable guide wheels support an exercise resistance cable 183 that is elastic. This configuration provides a very compact configuration through which the length of cables may be fully encapsulated within the seat back while still providing an amount of stored length necessary for proper elongation and related resistance force during use.

Figure 16:
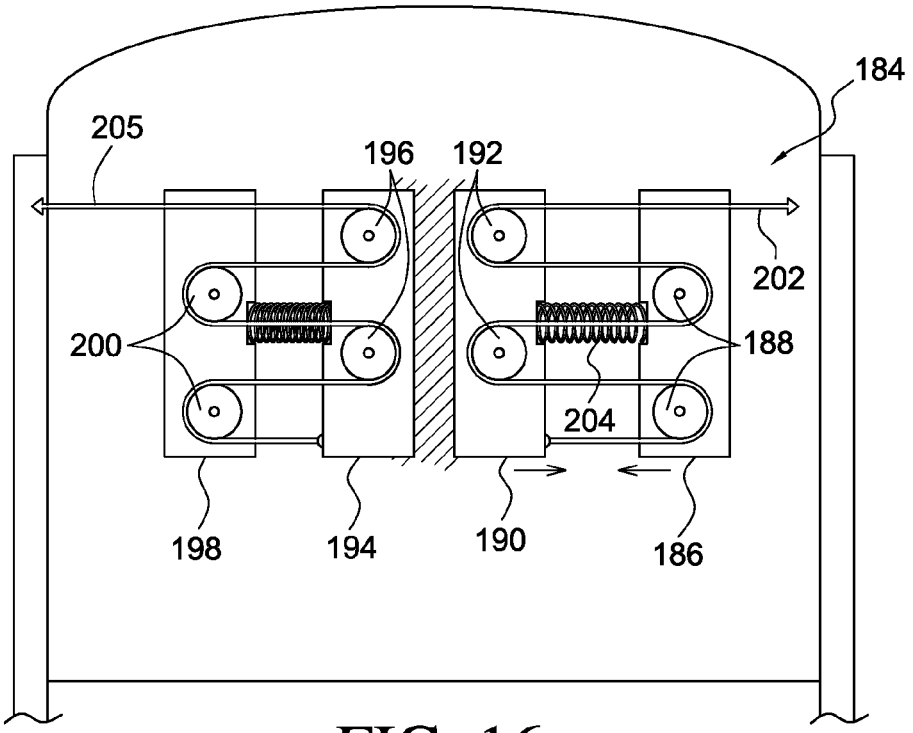
FIG. 16 is another alternative embodiment utilizing seat back subassemblies with translatable guide wheels, utilizing non-elastic exercise cables and compression springs.

Referring now to FIG. 16, another embodiment of the exercise system is illustrated, designated generally as 184. In this embodiment, the right seat back subassembly includes a right side, first support element (RSFSE) 190 for supporting a first subset 192 of a right set of spaced rotatable guide wheels; and, a right side, second support element (RSSSE) 186 for supporting a second subset 188 of the right set of spaced rotatable guide wheels. The RSFSE 190 and the RSSSE 186 are operatively connected in a manner that allows limited lateral translation therebetween. In this embodiment this operable connection is provided by a compression spring 204. In this embodiment, associated elements are able to move together or apart, such motion resisted or aided by associated compression spring 204. The overall resistance developed by this embodiment as well as the displacement of the cable while generating the resistance is controlled by the strength of the spring 204, the distance between the elements, and the number and diameter of the guide wheels. Any of these components can be adjustable. In this embodiment, the rotatable guide wheels 188, 192 support a non-elastic exercise resistance cable 202. Such a non-elastic exercise resistance cable may be formed of, for example, nylon or steel. Alternately, the cable can be slightly elastic to augment and cushion the resistance rise of the spring as the cable is pulled by the user.

The left seat back subassembly is of similar construction. It includes a left side, first support element (LSFSE) 194 for supporting a first subset of the left set of spaced rotatable guide wheels 196. A left side, second support element (LSSSE) 198 supports a second subset of the left set of spaced rotatable guide wheels 200. The LSFSE 194 and the LSSSE 198 are operatively connected in a manner that allows limited lateral translation therebetween. The rotatable guide wheels support a non-elastic exercise resistance cable 205. The cable may alternately be slightly elastic, as explained above.

Figure 17:
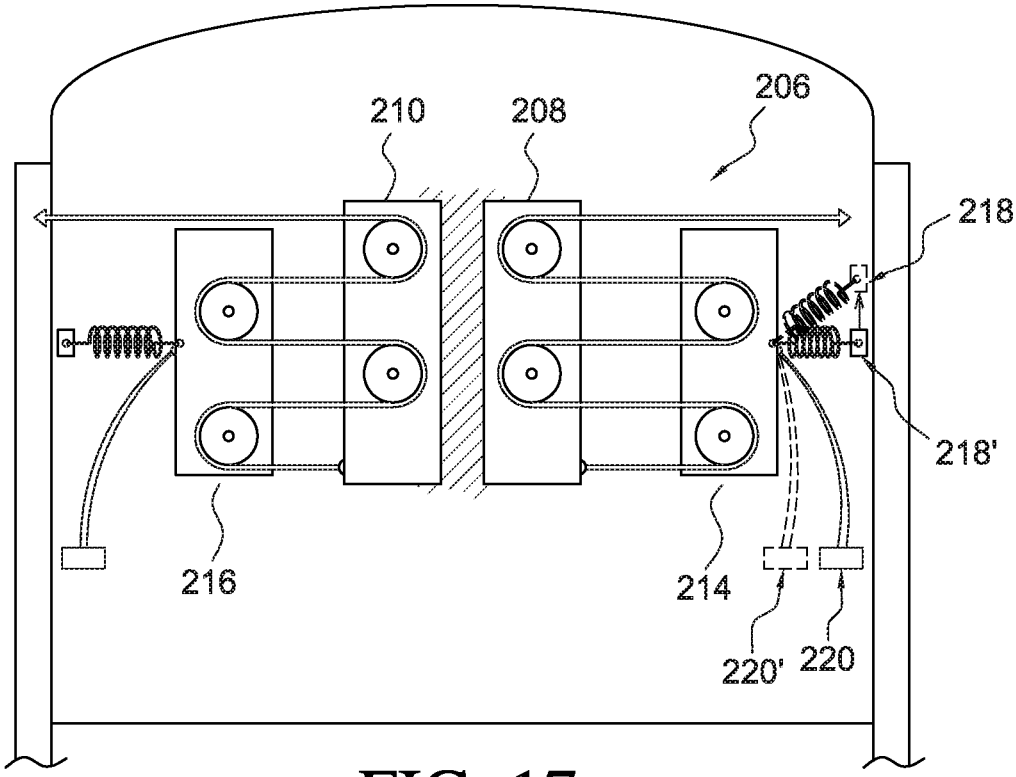
FIG. 17 is another alternative embodiment utilizing seat back subassemblies with translatable guide wheels, utilizing non-elastic exercise cables and tension springs or leaf springs.

Referring now to FIG. 17, another embodiment is illustrated, designated generally as 206. This embodiment is similar to the previous embodiment; however, in this embodiment the RSSSE 214 and the LSSSE 216 have limited lateral translation provided by a tension spring assembly, designated generally as 218 (or 218' after adjusting to decrease resistance); or, by a leaf spring assembly, designated generally as 220 (or 220' after adjusting to decrease resistance). The overall resistance developed by this embodiment, as well as the displacement of the cable while generating the resistance, is controlled by the strength of the spring, the distance between the elements, and the number and diameter of the guide wheels. Any of these components can be adjustable.

Figure 18:
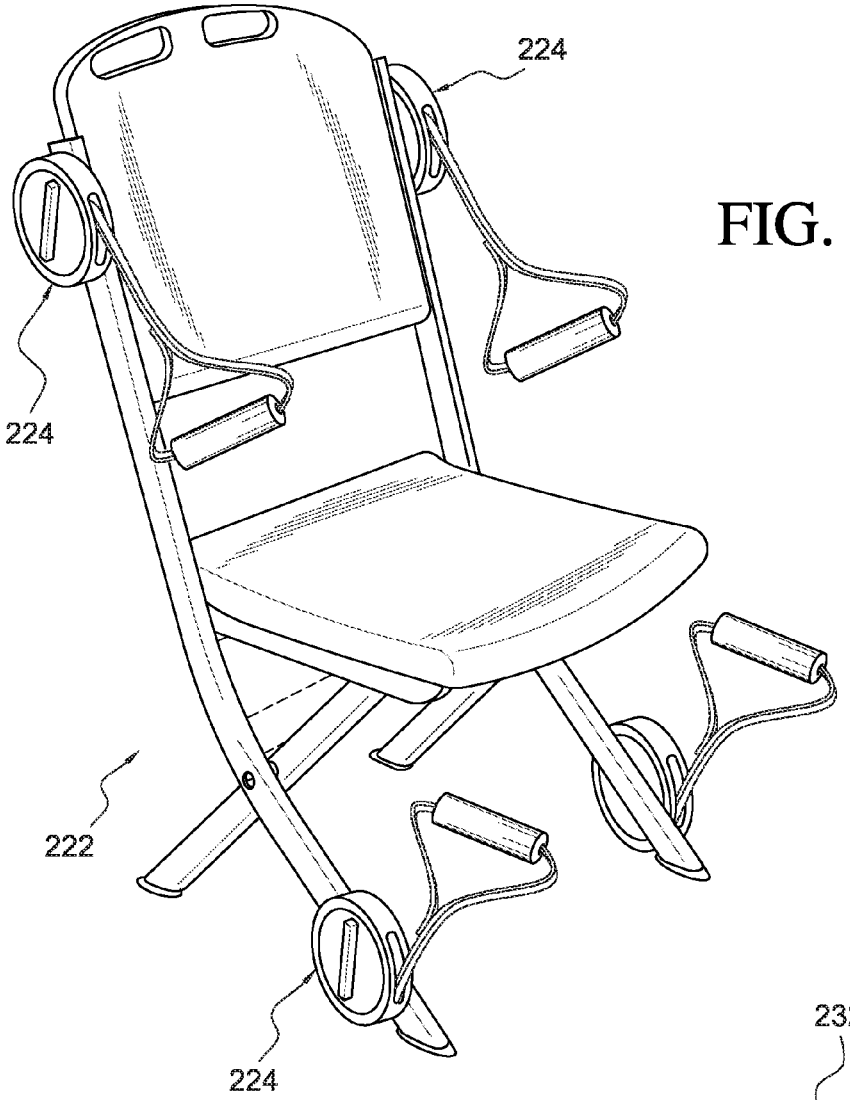
FIG. 18 illustrates a perspective view of the exercise system being implemented using retractable reel assemblies.
Figure 19:
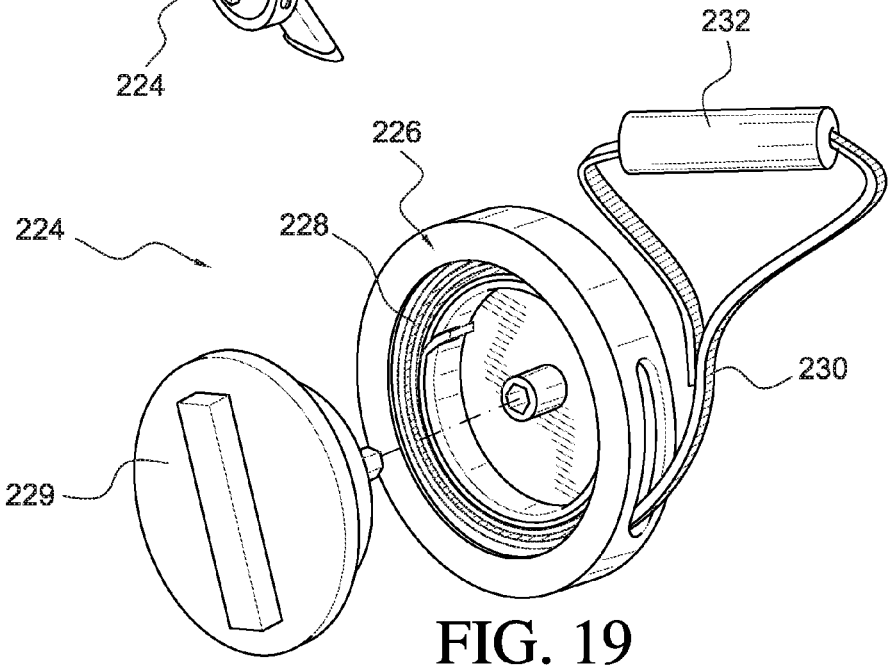
FIG. 19 is an enlarged view of a retractable reel assembly.

Referring now to FIGS. 18 and 19, another embodiment of the exercise chair is illustrated, designated generally as 222. In this embodiment the first, second, third and fourth force directing means each comprise a retractable reel assembly designated generally as 224. Each retractable reel assembly 224 includes a reel housing (i.e. drum) 226 securely connected at one of the selected locations at shoulder height and ankle height. A torsional spring assembly 228 is operably positionable within the reel housing 226. The exercise resistance cable includes a cable 230, operatively connected to the torsional spring assembly 224; and, a handle 232. The cable may be constructed having a generally flat cross sectional shape, to facilitate winding into the reel. The torsional spring assembly 228 may alternately be implemented as a spring "cassette" 229 that plugs into the drum 229. Cassettes 229 may be color coded to specify different resistances. The retractable reel assemblies 224 may include suitable safety mechanisms for preventing unintended retraction of the cable.

An alternate embodiment provides a cassette 229, that can be adjusted within the reel housing 226 to provide less or more resistance, for example by twisting the cassette.

Figure 20:
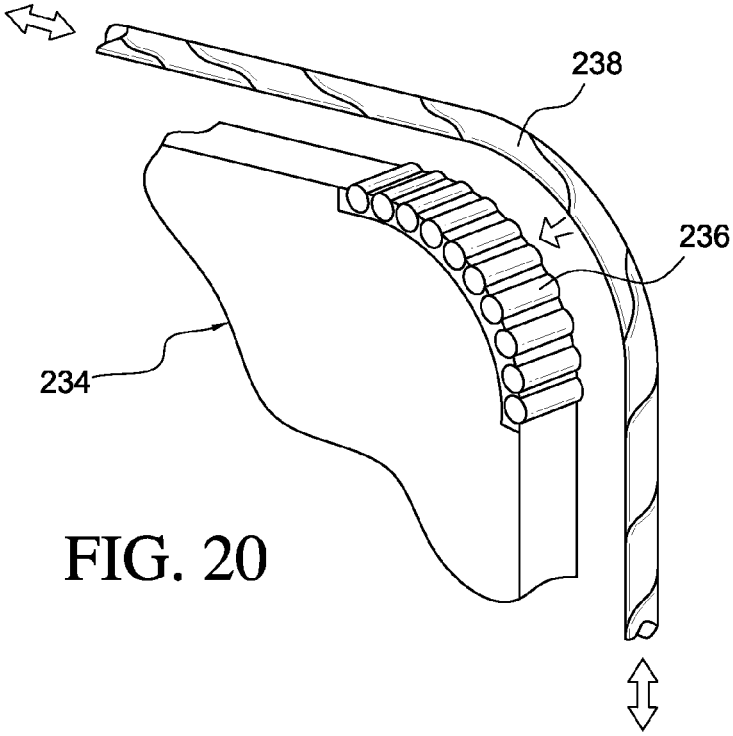
FIG. 20 illustrates a perspective view of the exercise system being implemented using needle bearing assemblies.

Referring now to FIG. 20, another embodiment is illustrated in which the first, second, third and fourth force directing means each comprise a needle bearing assembly, designated generally as 234. A number of needle bearings 236 are utilized to provide a means for directing a resistance cable 238 over a radius, or over a surface other than a simple radius as is the case with a single element pulley. The needle bearings may be arranged in such a fashion as to allow the cable to tuck more conveniently into the form of a chair or other supporting means to afford more freedom of functional or aesthetic designs. The cable 238 rolls over the bearings 236.

Figure 21:
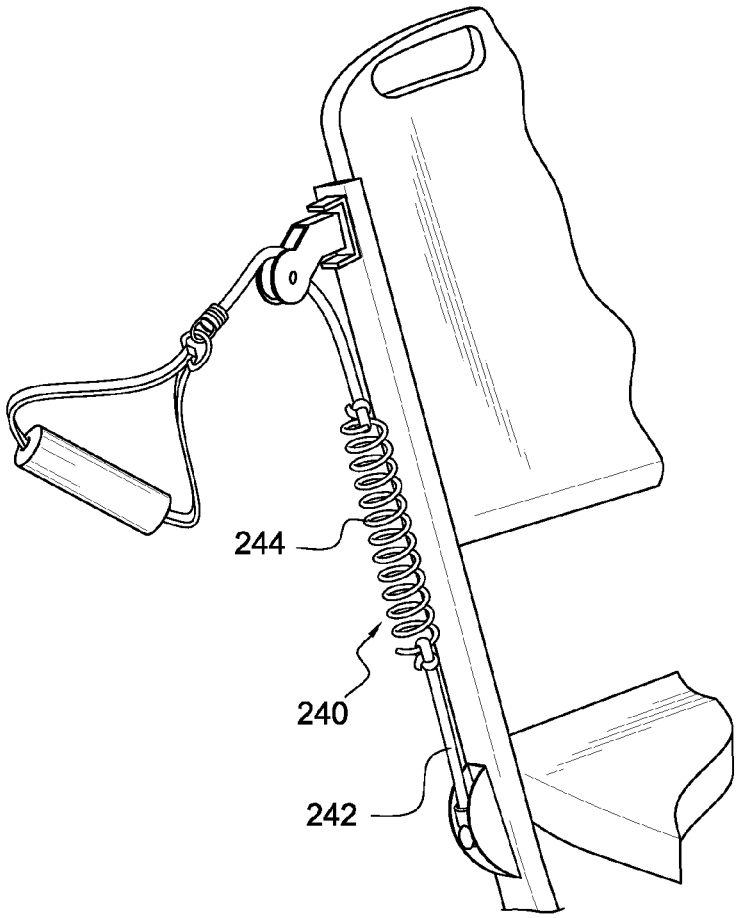
FIG. 21 illustrates utilization of an alternative exercise resistance cable utilizing a tension spring.

Referring now to FIG. 21, an alternative exercise resistance cable is illustrated, designated generally as 240, which utilizes an elastic exercise resistance cable section 242 and a tension spring 244 located within a portion of the exercise resistance cable section 242.

Obviously, many modifications and variations of the present invention are possible in light of the above teachings. It is, therefore, to be understood that within the scope of the appended claims, the invention may be practiced otherwise than as specifically described.

What is claimed is:

1. An exercise chair for an exercise system, said exercise system of a type that utilizes an exercise resistance cable apparatus of a type that includes an exercise resistance cable having a first end being connectable to an exercise chair, and; a handgrip connected to a second end of said exercise resistance cable, said exercise chair comprising:

a) a chair frame comprising a folding chair with four legs;

b) a first force directing means securely attached to said chair frame at a first selected location at approximately shoulder height level at the left side of said chair frame;

c) a second force directing means securely attached to said chair frame at a second selected location at approximately shoulder height level at the right side of said chair frame;

d) a third force directing means securely attached to said chair frame at a third selected location at approximately ankle height level at the right side of said chair frame; and, e) a fourth force directing means securely attached to said chair frame at a fourth selected location at approximately ankle height level at the left side of said chair frame;

f) wherein said first, second, third and fourth force directing means provide a redirection of force applied by a user at said shoulder and ankle height levels for a selectable exercise using a resistance cable introduced through selected force directing means during use.

2. The exercise chair of claim 1 wherein said first, second, third and fourth force directing means comprise rotatable elbow assemblies each having an interior channel with a low friction surface for slidable engagement of a resistance cable.

3. The exercise chair of claim 1 wherein said first, second, third and fourth force directing means comprise rotatable elbow assemblies having interior channels having low friction surfaces for slidable engagement of a resistance cable, each of said force directing means, comprising:

a) a swivel housing securely and rotatably connected to said chair frame; and, b) an elbow element secured to said swivel housing having said interior channel.

4. The exercise chair of claim 1 wherein said first, second, third and fourth force directing means comprise rotatable elbow assemblies having interior channels with low friction surfaces for slidable engagement of a resistance cable, each of said force directing means, comprising:

a) a swivel housing securely and rotatably connected to said chair frame; and, b) an elbow element secured to said swivel housing having said interior channel, said elbow element comprising a bent tubing element.

5. An exercise system, comprising:

a) an exercise chair, comprising:

i. a chair frame comprising a folding chair with four legs;

ii. a first force directing means securely attached to said chair frame at a first selected location at approximately shoulder height level at the left side of said chair frame;

iii. a second force directing means securely attached to said chair frame at a second selected location at approximately shoulder height level at the right side of said chair frame;

iv. a third force directing means securely attached to said chair frame at a third selected location at approximately ankle height level at the right side of said chair frame;

v. a fourth force directing means securely attached to said chair frame at a fourth selected location at approximately ankle height level at the left side of said chair frame;

wherein said first, second, third and fourth force directing means provide a redirection of force applied by a user at said shoulder and ankle height levels for a selectable exercise using a resistance cable; and, b) an exercise resistance cable apparatus, comprising:

i. an exercise resistance cable introducible through selected pulley assemblies during use, and;

ii. a handgrip connected said exercise resistance cable.

6. The exercise system of claim 5, wherein said exercise resistance cable, comprises:

a) an elastic exercise resistance cable section; and, b) a tension spring located within a portion of said exercise resistance cable section.

7. The exercise system of claim 5, wherein said exercise resistance cable is elastic.

8. The exercise chair of claim 1, wherein said chair frame, comprises:

a) a left chair frame elongated support element having a lower portion defining a front left leg;

b) a left chair frame cross-support element pivotally connected to said left chair frame elongated support element to define a rear left leg;

c) a right chair frame elongated support element having a lower portion defining a front right leg;

d) a left chair frame cross-support element pivotally connected to said left chair frame elongated support element to define a rear left leg;

wherein, said first selected location is at an upper end of said left chair frame elongated support element, said second selected location is at an upper end of said right chair frame elongated support element, said third selected location is at a lower end of said right chair frame elongated support element, and said fourth selected location is at a lower end of said left chair frame elongated support element.

9. The exercise chair of claim 1, wherein:

a) said first force directing means comprises a first pulley assembly;

b) said second force directing means comprises a second pulley assembly;

c) said third force directing means comprises a third pulley assembly; and, d) said fourth force directing means comprises a fourth pulley assembly.

10. The exercise chair of claim 1 wherein said chair frame includes a pair of front legs, each front leg being forwardly curved at an intermediate region thereof to enhance weight distribution for optimizing stability.

11. The exercise chair of claim 1 wherein each of said pulley assemblies defines an activity bay, each pulley assembly, comprising:

a) a u-bracket secured to said chair frame, said u-bracket having a pair of arms having respective u-bracket openings therein;

b) a pulley having a pulley opening extending through a first portion thereof, said pulley having a second portion having an activity bay opening formed therein defining said activity bay; and, c) a pulley pin extending through said pulley opening and through said u-bracket openings to secure said pulley to said support structure.

12. An exercise chair for an exercise system, said exercise system of a type that utilizes an exercise resistance cable apparatus of a type that includes an exercise resistance cable having a first end being connectable to an exercise chair, and; a handgrip connected to a second end of said exercise resistance cable, said exercise chair comprising:

a) a chair frame comprising a folding chair with four legs;

b) a first force directing means, comprising a first pulley assembly, securely attached to said chair frame at a first selected location at approximately shoulder height level at the left side of said chair frame;

c) a second force directing means, comprising a second pulley assembly, securely attached to said chair frame at a second selected location at approximately shoulder height level at the right side of said chair frame;

d) a third force directing means, comprising a third pulley assembly, securely attached to said chair frame at a third selected location at approximately ankle height level at the right side of said chair frame; and, e) a fourth force directing means, comprising a fourth pulley assembly, securely attached to said chair frame at a fourth selected location at approximately ankle height level at the left side of said chair frame;

wherein said first, second, third and fourth force directing means provide a redirection of force applied by a user at said shoulder and ankle height levels for a selectable exercise using a resistance cable introduced through selected pulley assemblies during use, wherein said chair frame comprises:

a) a left chair frame elongated support element having a lower portion defining a front left leg;

b) a left chair frame cross-support element pivotally connected to said left chair frame elongated support element to define a rear left leg;

c) a right chair frame elongated support element having a lower portion defining a front right leg;

d) a left chair frame cross-support element pivotally connected to said left chair frame elongated support element to define a rear left leg;

wherein, said first selected location is at an upper end of said left chair frame elongated support element, said second selected location is at an upper end of said right chair frame elongated support element, said third selected location is at a lower end of said right chair frame elongated support element, and said fourth selected location is at a lower end of said left chair frame elongated support element.

13. The exercise chair of claim 12 wherein said chair frame includes a pair of front legs, each front leg being forwardly curved at an intermediate region thereof to enhance weight distribution for optimizing stability.

* * * * *